US011920436B2

(12) United States Patent
Villarreal

(10) Patent No.: US 11,920,436 B2
(45) Date of Patent: Mar. 5, 2024

(54) DIFFERENTIAL FILL VALVE AND FLOAT COLLAR WITH TWO DEACTIVATION SLEEVES

(71) Applicant: Halliburton Energy Services, Inc., Houston, TX (US)

(72) Inventor: Frank Vinicia Acosta Villarreal, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/806,488

(22) Filed: Jun. 12, 2022

(65) Prior Publication Data

US 2023/0399920 A1 Dec. 14, 2023

(51) Int. Cl.

| | |
|---|---|
| ***E21B 34/14*** | (2006.01) |
| ***E21B 33/14*** | (2006.01) |
| ***E21B 34/06*** | (2006.01) |

(52) U.S. Cl.

CPC ..... *E21B 34/142* (2020.05); *E21B 33/14* (2013.01); *E21B 34/063* (2013.01); *E21B 2200/05* (2020.05); *E21B 2200/06* (2020.05)

(58) Field of Classification Search

CPC ..... E21B 34/102

See application file for complete search history.

(56) References Cited

U.S. PATENT DOCUMENTS

| | | | | |
|---|---|---|---|---|
| 4,729,432 | A | 3/1988 | Helms | |
| 10,208,567 | B2 | 2/2019 | Recchioni | |
| 2011/0290344 | A1 | 12/2011 | Groesbeck et al. | |
| 2012/0261136 | A1* | 10/2012 | Ehtesham | E21B 34/14 166/334.1 |
| 2014/0083689 | A1* | 3/2014 | Streich | E21B 34/102 166/250.15 |
| 2018/0112493 | A1 | 4/2018 | Recchioni | |
| 2020/0355046 | A1* | 11/2020 | Kratochvil | E21B 43/26 |

* cited by examiner

*Primary Examiner* — William D Hutton, Jr.
*Assistant Examiner* — Avi T Skaist
(74) *Attorney, Agent, or Firm* — Sheri Higgins; Sheri Higgins Law, PLLC

(57) ABSTRACT

A downhole tool can be used as a fill valve to circulate a fluid, such as a spacer fluid, through the tool. The tool can include a top and bottom flapper valve and an inner and outer sliding sleeve. The sliding sleeves can be shifted together to allow the top flapper valve to close. Continued shifting of the inner sleeve can cause the bottom flapper valve to close. A cementing operation can then be performed through the tool. Sealing elements can be located between the outside of the inner sleeve and inside of the outer sleeve. Sealing elements can also be located between the outside of the outer sleeve and the inside of a tool mandrel. The sealing elements can prevent debris from becoming lodged within the tool.

20 Claims, 4 Drawing Sheets

DIFFERENTIAL FILL VALVE AND FLOAT COLLAR WITH TWO DEACTIVATION SLEEVES

TECHNICAL FIELD

The field relates to a fill valve and float collar for an oil or gas operation. The valve assembly includes two sleeves that each deactivate a flapper valve.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
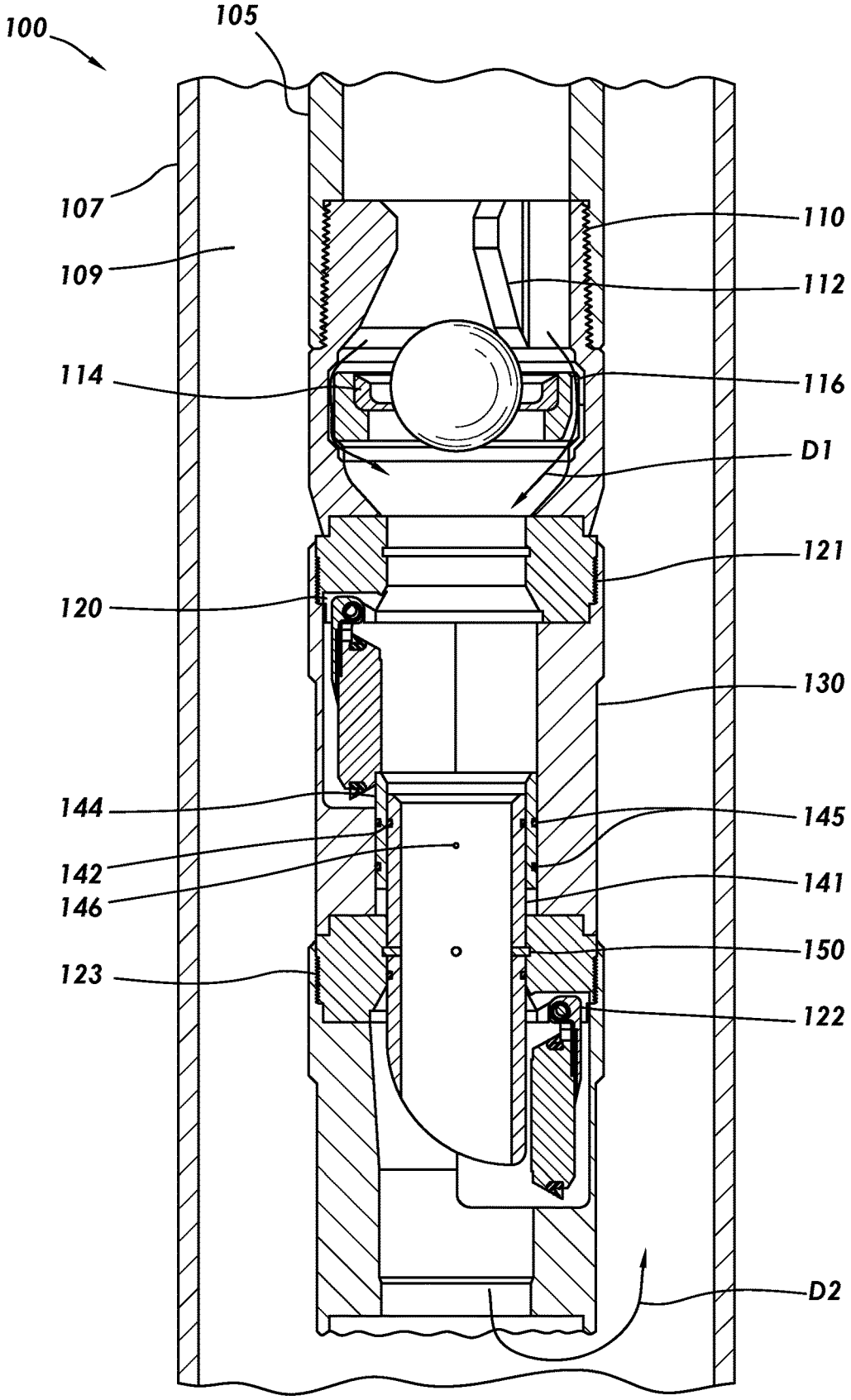
FIG. 1 illustrates a valve assembly during run in with both flapper valves in an open position for filling with a drilling fluid during run-in according to certain embodiments.

Oil and gas hydrocarbons are naturally occurring in some subterranean formations. In the oil and gas industry, a subterranean formation containing oil and/or gas is referred to as a reservoir. A reservoir can be located on land or offshore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid.

As used herein, a "fluid" is a substance having a continuous phase that can flow and conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase; whereas a heterogeneous fluid has more than one distinct phase. A colloid is an example of a heterogeneous fluid. A heterogeneous fluid can be: a slurry, which includes a continuous liquid phase and undissolved solid particles as the dispersed phase; an emulsion, which includes a continuous liquid phase and at least one dispersed phase of immiscible liquid droplets; a foam, which includes a continuous liquid phase and a gas as the dispersed phase; or a mist, which includes a continuous gas phase and liquid droplets as the dispersed phase.

A well can include, without limitation, an oil, gas, or water production well, an injection well, or a geothermal well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a well" means and includes into any portion of the well, including into the wellbore, into the near-wellbore region via the wellbore, or into the subterranean formation via the wellbore.

A portion of a wellbore can be an open hole or cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include but are not limited to the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

A wellbore is formed using a drill bit. A drill string can be used to aid the drill bit in drilling through the subterranean formation to form the wellbore. The drill string can include a drilling pipe. During drilling operations, a drilling fluid, sometimes referred to as a drilling mud, may be circulated downwardly through the drilling pipe, and back up the annulus between the wellbore and the outside of the drilling pipe. The drilling fluid performs various functions, such as cooling the drill bit, maintaining the desired pressure in the well, and carrying drill cuttings upwardly through the annulus between the wellbore and the drilling pipe.

During well completion, it is common to introduce a cement composition into an annulus in a wellbore. For example, in a cased-hole wellbore, a cement composition can be placed into and allowed to set in the annulus between the wellbore and the casing in order to stabilize and secure the casing in the wellbore. By cementing the casing in the wellbore, fluids are prevented from flowing into the annulus. Consequently, oil or gas can be produced in a controlled manner by directing the flow of oil or gas through the casing and into the wellhead. Cement compositions can also be used in primary or secondary cementing operations, well-plugging, or squeeze cementing. As used herein, a "cement composition" is a mixture of at least cement and water, and possibly other additives.

A spacer fluid can be introduced into the wellbore after the drilling fluid and before the cement composition. The spacer fluid can be circulated down through a drill string or tubing string and up through the annulus. The spacer fluid functions to remove the drilling fluid from the wellbore. A differential fill valve tool can be used to circulate the spacer fluid down through the tubing string and up through the annulus. The differential valve tool can have a larger inner diameter that allows a high flow rate of fluids to be pumped through the tool.

After the wellbore has been formed, the drill string can be removed from the wellbore and a tubing string can be placed in the wellbore. During run-in of the tubing string and the differential valve tool, the wellbore can become damaged by surge pressure from displaced wellbore fluids exerting pressure on the wellbore. One way to help combat surge pressure is by using a float collar on the bottom of the tubing string. The float collar can allow fluids to flow into the tubing string while the tubing string is being lowered into the wellbore during run-in. By allowing wellbore fluids to enter the tubing string, the surge pressure can be reduced or eliminated. In this manner, running-in of the tubing string can take considerably less time than running in a tubing string without a float collar.

A tool which is a combination differential fill valve and float collar can be used to allow circulation of fluids after drilling and also relieve surge pressures during run-in. The tool can include one or more valves that are open during run-in and the circulation of fluids. the one or more valves can be closed. A cement composition can then be pumped through the tubing string and the tool whereby the cement composition opens the one or more valves, but close when pumping stops thereby preventing any fluids from entering the tool from the bottom.

There are several problems with tools used as a fill valve and float collar. Some tools utilize a sliding sleeve that retains the valve in an open position during run-in and circulation. The tools utilize a lock ring that expand and shift the sliding sleeve so the valve can close. However, during run-in, it is not uncommon for debris to be present in the wellbore fluids that the tool must pass through during run-in. The debris can become lodged within a number of the tool components. For example, if debris becomes lodged behind the lock ring, then the lock ring cannot expand and thus, the sliding sleeve cannot be shifted, and the valve cannot close. Another problem with such tools is that the activation needed to shift the sliding sleeve can be too sensitive and the sleeve can be shifted during shipment or transport of the tool, thus, rendering the tool unusable. Even if the tool is not prematurely activated during transport, the sensitivity can cause premature closing of the valve, thus, delaying the oil and gas operation, such as a cementing operation, or requiring the tool to be removed from the wellbore and another tool run-in. Accordingly, there exists a need for improved tools that can be used as a fill valve and float collar that solves the aforementioned problems.

It has been discovered that a downhole tool can include a top and lower flapper valve and 2 sliding sleeves. A first and second sliding sleeve can be shifted down, which allows a top valve to close. Continued shifting of the first sliding sleeve can allow a lower valve to close. The downhole tool is configured such that debris cannot become lodged in components of the tool that would prevent shifting of both sleeves. The downhole tool also does not rely on nor require lock rings.

A downhole tool can include: a first valve configured to convert from an open position to a closed position; a second valve configured to convert from an open position to a closed position; a first sliding sleeve; and a second sliding sleeve, wherein the first sliding sleeve is releasably connected to the second sliding sleeve, wherein shifting of the first sliding sleeve and the second sliding sleeve to a location below the first valve converts the first valve from the open position to the closed position, and wherein shifting of the first sliding sleeve to a location below the second valve converts the second valve from the open position to the closed position.

Methods of cementing in a wellbore can include introducing a tubing string and a downhole tool installed on a bottom of the tubing string into the wellbore, wherein the downhole tool comprises: a first valve; a second valve; a first sliding sleeve; and a second sliding sleeve, wherein the first sliding sleeve is releasably connected to the second sliding sleeve; causing the first sliding sleeve and the second sliding sleeve to shift to a location below the first valve, wherein the shifting causes the first valve to close; and causing the first sliding sleeve to shift to a location below the second valve, wherein the shifting causes the second valve to close.

It is to be understood that the discussion of any of the embodiments regarding the downhole tool is intended to apply to all of the method and apparatus embodiments without the need to repeat the various embodiments throughout. Any reference to the unit "gallons" means U.S. gallons.

Turning to the figures, FIG. 1 illustrates the downhole tool 100 during introduction into a wellbore—commonly known in the industry as being run-in. The downhole tool 100 can be installed on a bottom end of a tubing string 105. The tubing string 105 and the downhole tool 100 can be introduced into a wellbore inside a casing string 107. An annulus 109 can be defined as the space located between the inside of the casing string 107 and the outside of the tubing string 105 and downhole tool 100. According to other embodiments, the wellbore can be an open-hole wellbore and the annulus 109 can be defined as the space located between the inside wall of the wellbore and the outside of the tubing string 105 and the downhole tool 100. According to any of the embodiments, the tubing string 105 and the downhole tool 100 are introduced into the wellbore after a drilling operation has been performed.

The downhole tool 100 can include a ball cage 110. The ball cage 110 can be connected to a lower end of the tubing string 105. The ball cage 110 can house a ball 112. The ball 112 can be seated on a ball seat 114. If a ball cage 110 is used, the ball cage 110 can include one or more fluid ports 116 located at a desired spacing pattern adjacent to the ball seat 114. In this manner, a fluid can be pumped through the tubing string 105 to the downhole tool 100 and flow around the outside of the ball 112 and through the one or more fluid ports 116 in a direction D1 and into a mandrel 130 of the downhole tool 100. The dimensions, the number, and the spacing of the fluid ports 116 can be selected based on an anticipated flow rate of a fluid being pumped downhole.

The downhole tool includes a mandrel 130. The downhole tool includes a first valve 120 and a second valve 122 installed on the mandrel 130, for example, via a first valve housing 121 and a second valve housing 123. The mandrel 130 can have a fluid flow passageway through the inside of the mandrel 130 whereby a fluid can flow through the mandrel 130. The first and second valves 120/122 can be flapper valves. The first valve 120 can be located adjacent to the ball cage 110 and the second valve 122 can be located below the first valve 120. As used herein, the relative terms "up," "down," "above," and "below" are for reference purposes only to orient the different components, with up and above being closer to the wellhead and down and below being further away from the wellhead for a vertical wellbore. It is to be understood that for a horizontal wellbore that curves to the right, up and above may be to the left of the other reference component and vice versa for a wellbore that curves to the left. By way of example, in a horizontal wellbore that curves to the right, the first valve 120 would be located to the left of the second valve 122.

As shown in FIG. 1, the downhole tool is shown in the run-in position wherein the first valve 120 and the second valve 122 are in an open position. This allows any surge pressure from the drilling fluid during run-in to be reduced or eliminated. In practice, after a drilling operation is performed, the tubing string 105 and the downhole tool 100 can be run-in wellbore. After the downhole tool 100 is in a desired location within the wellbore, a fluid can be pumped through the tubing string 105, through the fluid ports 116 in the direction D1 (if a ball cage 110 is included), through the inside of the mandrel 130, and up into the annulus 109 in the direction D2. In this manner, the downhole tool 100 can function as a differential fill valve. The fluid can be any fluid, for example, a spacer fluid that functions to displace drilling fluid within the wellbore to prepare the wellbore for a cementing operation.

The downhole tool 100 includes a first sliding sleeve 141 and a second sliding sleeve 144. The first sliding sleeve 141 can be releasably connected to the second sliding sleeve 144 by a connector pin 146. There can also be more than one connector pin 146 that releasably connects the first sliding sleeve 141 to the second sliding sleeve 144.

The first sliding sleeve 141 can be releasably attached to the second valve housing 123 by a frangible device 150. The frangible device 150 can be any device that is capable of withstanding a predetermined amount of force and capable of releasing at a force above the predetermined amount of force. The frangible device 150 can be, for example, a shear pin, a shear screw, a shear ring, a load ring, a pin, or a lug. There can also be more than one frangible device 150 that connects the first sliding sleeve 141 to the second valve housing 123. The connector pin 146 can also be a device that is capable of withstanding a predetermined amount of force and capable of releasing at a force above the predetermined force. The frangible device 150 and the connector pin 146 can be selected based on the force rating of the device and pin, the total number of devices used, and the predetermined amount of force needed to release the device and pin. For example, if the total force required to break or shear the frangible device is 15,000 pounds force ($lb_f$) and each frangible device has a rating of 5,000 $lb_f$, then a total of three frangible devices may be used. According to any of the embodiments, the force rating of the frangible device 150 is less than the force rating of the connector pin 146. In this manner, the frangible device 150 shears first and then with a continued increase in pressure, the second sleeve 144 shifts down and contacts the second valve housing 123 and the connector pin 146 shears.

The first sliding sleeve 141 can include one or more sealing elements 142, such as O-rings, located between the outside of the first sliding sleeve 141 and the inside of the second sliding sleeve 144. The sealing elements 142 can prevent debris from other materials from entering and lodging between the sliding sleeves. The outer diameter (OD) of the first sliding sleeve 141 can be selected based on the inner diameter (ID) of the second sliding sleeve 144 such that the first sliding sleeve 141 can shift down relative to the second sliding sleeve. In this manner, the clearance between the OD of the first sliding sleeve and the ID of the second sliding sleeve can be just enough to allow placement of the sealing elements 142 and prevent debris from entering the space between the OD of the first sleeve and the ID of the second sleeve.

As can also be seen, the second sliding sleeve 144 can include one or more sealing elements 145 located between the outside of the second sliding sleeve 144 and the inside of the mandrel 130. The sealing elements 145 can also prevent debris or other materials from entering and lodging between the second sliding sleeve 144 and the mandrel 130. The outer diameter (OD) of the second sliding sleeve 144 can be selected based on the inner diameter (ID) of the mandrel 130 such that the second sliding sleeve 144 can shift down relative to the mandrel. In this manner, the clearance between the OD of the second sliding sleeve and the ID of the mandrel can be just enough to allow placement of the sealing elements 145 and prevent debris from entering the space between the OD of the second sleeve and the ID of the mandrel. In this manner, the reliability and functionality of the downhole tool 100 is not impaired if debris is encountered during run-in.

Figure 2:
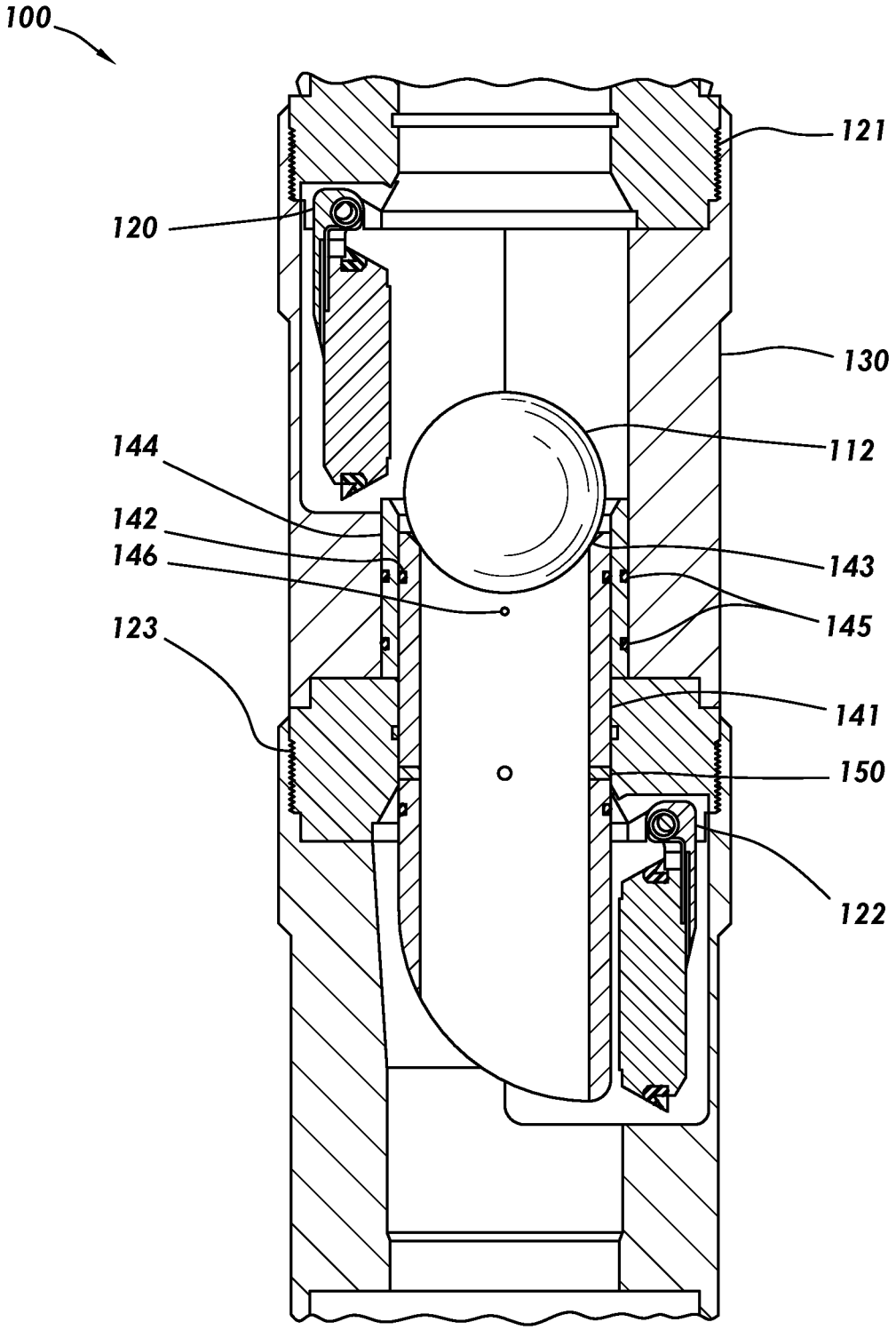
FIG. 2 illustrates the valve assembly after a ball has landed on a ball seat of a first sleeve.

The methods can include causing the first sliding sleeve 141 and the second sliding sleeve 144 to shift to a location below the first valve 120. As can be seen in FIG. 2, the ball 112 can land on a ball seat 143 on the first sliding sleeve 141. With reference to FIG. 1, the ball 112 can be initially seated on the ball seat 114 of the ball cage 110. A pressure differential above the ball 112 can be increased such that the ball seat 114 bends and deforms downwardly and allows the ball 112 to pass through the ball seat 114 and land on the ball seat 143 on the first sliding sleeve 141. The downhole tool 100 may not include the ball cage 110. According to this embodiment, the ball 112 can be pumped down the tubing string 105 to land on the ball seat 143 on the first sliding sleeve 141.

Figure 3:
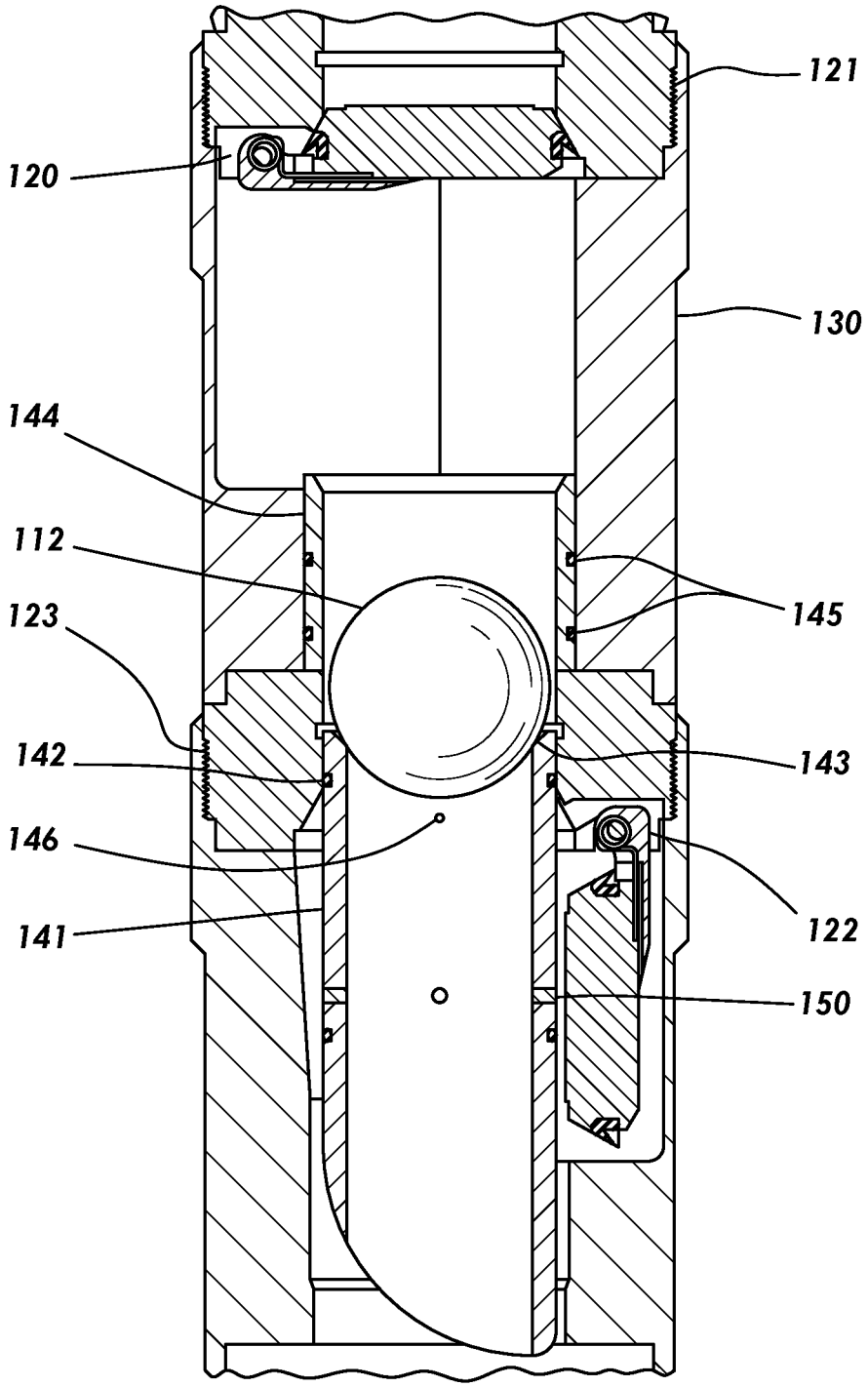
FIG. 3 illustrates the valve assembly showing the ball shifting the first sleeve and the top valve in a closed position.

It is to be understood that reference to a "ball" is not meant to limit the geometric shape of the ball to spherical, but rather is meant to include any device that is capable of engaging with a seat. A "ball" can be spherical in shape, but can also be a dart, a bar, or any other shape. The ball 112 engages with the ball seat 143 on the first sliding sleeve 141, and the seal created by this engagement prevents fluid communication downstream of the ball and seat. A pressure differential is created after the seal is created by engagement of the ball 112 with the ball seat 143. Referring to FIGS. 2 and 3, the pressure differential can cause the frangible device 150 to shear, thereby releasing the first sliding sleeve 141 from connection with the second valve housing 123. After the frangible device 150 shears, both of the first sliding sleeve 141 and the second sliding sleeve 144 can shift downwardly. The first sliding sleeve 141 and the second sliding sleeve 144 can move downwardly together due to the connector pin 146 being intact, the sealing elements 142, or both. The sealing elements 142, for example, can withstand a force load of up to 200 pounds. In this manner, the sealing elements 142 can help ensure that the first sliding sleeve 141 and the second sliding sleeve 144 shift downwardly together. The force load of the sealing elements 142/145 can also prevent premature shifting of the first and/or second sliding sleeves, for example, during transport and circulation of a fluid through the downhole tool 100. As can be seen in FIG. 2, after shifting, a bottom end of the second sliding sleeve 144 can abut a top of the second valve housing 123. In this manner, the second sliding sleeve 144 is prevented from shifting further down the downhole tool 100.

With a continued increase in pressure the connector pin 146 can shear and the pressure may be greater than the force load of the sealing elements 142 such that the first sliding sleeve 141 continues to move downward within the mandrel 130 and the second sliding sleeve 144 remains abutted against the top of the second valve housing 123. According to any of the embodiments, the inner diameter of the second sliding sleeve 144 is larger than the outer diameter of the ball 112. In this manner, the ball 112 and the first sliding sleeve 141 can continue moving downward through the second sliding sleeve 144 and the mandrel 130. This continued shifting of the first sliding sleeve 141 can position the first sliding sleeve 141 and the second sliding sleeve 144 at a location below the first valve 120. This allows the first valve 120 to convert from the open position shown in FIG. 1 to a closed position as shown in FIG. 3. The flap can rotate into the closed position via a hinge for example on the first valve housing 121.

Figure 4:
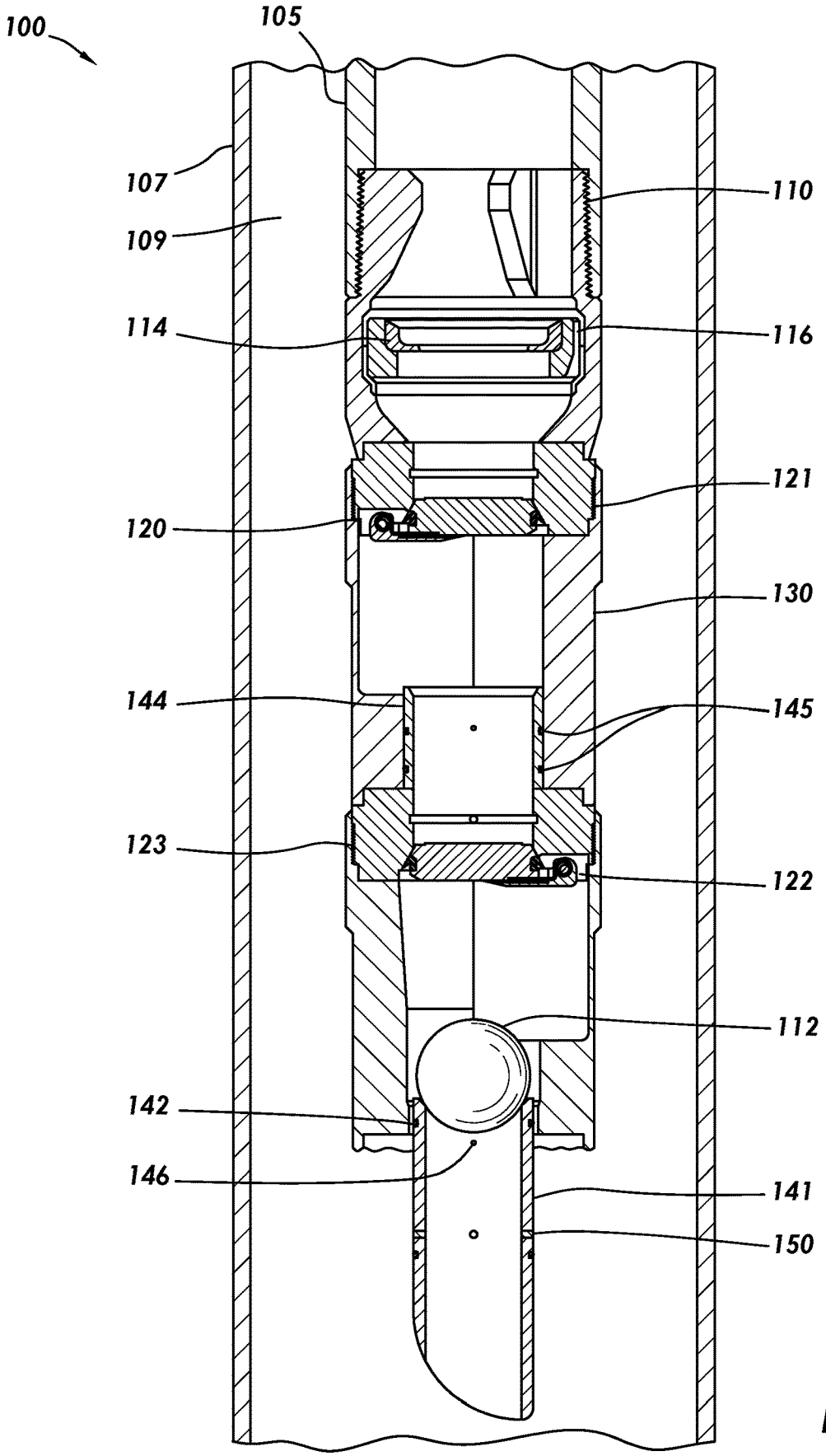
FIG. 4 illustrates the valve assembly after the first sleeve has shifted below a lower valve and the lower valve in a closed position.

With reference to FIG. 4, the first sliding sleeve 141 and the ball 112 can continue to travel in a downward direction within the mandrel 130 until the first sliding sleeve 141 has shifted to a location below the second valve 122. The first sliding sleeve 141 can be shifted to a location below the mandrel 130 of the downhole tool 100 and into a bottom of the wellbore. This allows the second valve 122 to convert from the open position shown in FIGS. 1-3 to a closed as shown in FIG. 4. The flap of the second valve 122 can rotate into the close position via a hinge for example on the second valve housing 123.

Although shown in the figures with a hinge for the first valve 120 being located opposite from a hinge of the second valve 122, it is to be understood that the hinges can be located on the same side of the mandrel 130.

The methods can further include recirculating a fluid, such as a spacer fluid, through the tubing string 105 and the downhole tool 100 after introduction into the wellbore and when the first valve 120 and the second valve 122 are in an open position. The methods can further include introducing a cement composition into the wellbore after the first and second sliding sleeves have shifted down. The cement composition can be pumped down through the tubing string 105 and through the downhole tool 100. The pump pressure can be greater than or equal to the force needed to push the flaps of the first valve 120 and the second valve 122 open thereby allowing the cement composition to flow out of the downhole tool 100 and up into the annulus 109 of the wellbore. When the pump pressure falls below the force needed to push the flaps of the valves open, the first and second valves can close, thereby preventing a fluid from entering the downhole tool 100 from the bottom.

The components of the downhole tool can be made from a variety of components including, but not limited to, metals, metal alloys, composites, plastics, and rubbers.

An embodiment of the present disclosure is a downhole tool comprising: a mandrel; a first valve configured to convert from an open position to a closed position; a second valve configured to convert from an open position to a closed position; a first sliding sleeve; and a second sliding sleeve, wherein the first sliding sleeve is releasably connected to the second sliding sleeve, wherein shifting of the first sliding sleeve and the second sliding sleeve to a location below the first valve converts the first valve from the open position to the closed position, and wherein shifting of the first sliding sleeve to a location below the second valve converts the second valve from the open position to the closed position. Optionally, the downhole tool further comprises a ball cage, a ball seat located within the ball cage, and one or more fluid ports located adjacent to the ball seat, wherein the ball cage is connected to a lower end of a tubing string above the first sliding sleeve and the second sliding sleeve. Optionally, the downhole tool further comprises wherein the first and second valves are flapper valves. Optionally, the downhole tool further comprises wherein the first sliding sleeve is releasably connected to the second sliding sleeve by a connector pin. Optionally, the downhole tool further comprises wherein the first sliding sleeve is releasably connected to a second valve housing by a frangible device, and wherein the frangible device is selected from a shear pin, a shear screw, a shear ring, a load ring, a pin, or a lug. Optionally, the downhole tool further comprises wherein a force rating of the frangible device is less than a force rating of the connector pin. Optionally, the downhole tool further comprises one or more sealing elements located between an outside of the first sliding sleeve and an inside of the second sliding sleeve. Optionally, the downhole tool further comprises one or more sealing elements located between an outside of the second sliding sleeve and an inside of the mandrel.

Another embodiment of the present disclosure is a method of cementing in a wellbore comprising: introducing a tubing string and a downhole tool installed on a bottom of the tubing string into the wellbore, wherein the downhole tool comprises: a first valve; a second valve; a first sliding sleeve; and a second sliding sleeve, wherein the first sliding sleeve is releasably connected to the second sliding sleeve; causing the first sliding sleeve and the second sliding sleeve to shift to a location below the first valve, wherein the shifting allows the first valve to close; and causing the first sliding sleeve to shift to a location below the second valve, wherein the shifting allows the second valve to close. Optionally, the method further comprises landing a ball on a ball seat located on the first sliding sleeve, wherein after the ball has landed on the ball seat, a pressure differential is created. Optionally, the method further comprises wherein the downhole tool further comprises a ball cage, a ball seat located within the ball cage, and one or more fluid ports located adjacent to the ball seat, wherein the ball cage is connected to a lower end of a tubing string above the first sliding sleeve and the second sliding sleeve. Optionally, the method further comprises wherein an increased pressure above the ball causes the first sliding sleeve and the second sliding sleeve to shift to the location below the first valve. Optionally, the method further comprises causing the ball to flow through the ball seat located within the ball cage before landing on the ball seat located on the first sliding sleeve. Optionally, the method further comprises wherein the first sliding sleeve is releasably connected to a second valve housing by a frangible device. Optionally, the method further comprises wherein a pressure differential across a ball engaged with a ball seat located on the first sliding sleeve causes the frangible device to shear, thereby releasing the first sliding sleeve from connection with the second valve housing and causes the first sliding sleeve and the second sliding sleeve to shift to a location below the first valve. Optionally, the method further comprises wherein after shifting, a bottom end of the second sliding sleeve abuts a top of the second valve housing. Optionally, the method further comprises wherein the first sliding sleeve is releasably connected to the second sliding sleeve by a connector pin, and wherein after the second sliding sleeve abuts the top of the second valve housing, the connector pin shears. Optionally, the method further comprises wherein shearing of the connector pin allows the ball and the first sliding sleeve to shift to the location below the second valve. Optionally, the method further comprises recirculating a fluid through the tubing string and the downhole tool after introduction into the wellbore and prior to causing the first sliding sleeve and the second sliding sleeve to shift. Optionally, the method further comprises wherein the fluid is a drilling fluid or a spacer fluid. Optionally, the method further comprises introducing a cement composition into the wellbore after the first valve and the second valve are allowed to close.

Therefore, the apparatus, methods, and systems of the present disclosure are well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present disclosure.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more sleeves, etc., as the case may be, and do not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent(s) or other documents that may be incorporated herein by reference, the definitions that are consistent with this specification should be adopted.

What is claimed is:

1. A downhole tool comprising:

a mandrel;

a first valve configured to convert from an open position to a closed position;

a second valve configured to convert from an open position to a closed position;

a first sliding sleeve; and a second sliding sleeve, wherein the first sliding sleeve is releasably connected to the second sliding sleeve, wherein shifting of the first sliding sleeve and the second sliding sleeve to a location below the first valve converts the first valve from the open position to the closed position, wherein shifting of the first sliding sleeve to a location below the second valve converts the second valve from the open position to the closed position, and wherein a fluid flow path through the mandrel from a bottom of the downhole tool is closed when the first valve and the second valve are in the closed position.

2. The downhole tool according to claim 1, further comprising a ball cage, a ball seat located within the ball cage, and one or more fluid ports located adjacent to the ball seat, wherein the ball cage is connected to a lower end of a tubing string above the first sliding sleeve and the second sliding sleeve.

3. The downhole tool according to claim 1, wherein the first and second valves are flapper valves.

4. The downhole tool according to claim 1, wherein the first sliding sleeve is releasably connected to the second sliding sleeve by a connector pin.

5. The downhole tool according to claim 4, wherein the first sliding sleeve is releasably connected to a second valve housing by a frangible device, and wherein the frangible device is selected from a shear pin, a shear screw, a shear ring, a load ring, a pin, or a lug.

6. The downhole tool according to claim 5, wherein a force rating of the frangible device is less than a force rating of the connector pin.

7. The downhole tool according to claim 1, further comprising one or more sealing elements located between an outside of the first sliding sleeve and an inside of the second sliding sleeve.

8. The downhole tool according to claim 1, further comprising one or more sealing elements located between an outside of the second sliding sleeve and an inside of the mandrel.

9. A method of cementing in a wellbore comprising:

introducing a tubing string and a downhole tool installed on a bottom of the tubing string into the wellbore, wherein the downhole tool comprises:

a first valve;

a second valve;

a first sliding sleeve; and a second sliding sleeve, wherein the first sliding sleeve is releasably connected to the second sliding sleeve;

causing the first sliding sleeve and the second sliding sleeve to shift to a location below the first valve, wherein the shifting allows the first valve to close; and causing the first sliding sleeve to shift to a location below the second valve, wherein the shifting allows the second valve to close, wherein a fluid flow path through the mandrel from a bottom of the downhole tool is closed when the first valve and the second valve are in the closed position.

10. The method according to claim 9, further comprising landing a ball on a ball seat located on the first sliding sleeve, wherein after the ball has landed on the ball seat, a pressure differential is created.

11. The method according to claim 10, wherein an increased pressure above the ball causes the first sliding sleeve and the second sliding sleeve to shift to the location below the first valve.

12. The method according to claim 11, wherein the downhole tool further comprises a ball cage, a ball seat located within the ball cage, and one or more fluid ports located adjacent to the ball seat, wherein the ball cage is connected to a lower end of a tubing string above the first sliding sleeve and the second sliding sleeve.

13. The method according to claim 12, further comprising causing the ball to flow through the ball seat located within the ball cage before landing on the ball seat located on the first sliding sleeve.

14. The method according to claim 9, wherein the first sliding sleeve is releasably connected to a second valve housing by a frangible device, and wherein a pressure differential across a ball engaged with a ball seat located on the first sliding sleeve causes the frangible device to shear, thereby releasing the first sliding sleeve from connection with the second valve housing and causes the first sliding sleeve and the second sliding sleeve to shift to a location below the first valve.

15. The method according to claim 14, wherein after shifting, a bottom end of the second sliding sleeve abuts a top of the second valve housing.

16. The method according to claim 15, wherein the first sliding sleeve is releasably connected to the second sliding sleeve by a connector pin, and wherein after the second sliding sleeve abuts the top of the second valve housing, the connector pin shears.

17. The method according to claim 16, wherein shearing of the connector pin allows the ball and the first sliding sleeve to shift to the location below the second valve.

18. The method according to claim 9, further comprising recirculating a fluid through the tubing string and the downhole tool after introduction into the wellbore and prior to causing the first sliding sleeve and the second sliding sleeve to shift.

19. The method according to claim 18, wherein the fluid is a drilling fluid or a spacer fluid.

20. The method according to claim 9, further comprising introducing a cement composition into the wellbore after the first valve and the second valve are allowed to close.

* * * * *